US007060886B2

(12) United States Patent
Tomizawa et al.

(10) Patent No.: US 7,060,886 B2
(45) Date of Patent: Jun. 13, 2006

(54) MUSIC PLAYBACK UNIT AND METHOD FOR CORRECTING MUSICAL SCORE DATA

(75) Inventors: Masao Tomizawa, Kanagawa (JP); Kaoru Tsukamoto, Tokyo (JP); Tomohiro Iwanaga, Tokyo (JP); Kimito Horie, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 363 days.

(21) Appl. No.: 10/619,508

(22) Filed: Jul. 16, 2003

(65) Prior Publication Data

US 2004/0173084 A1 Sep. 9, 2004

(30) Foreign Application Priority Data

Nov. 6, 2002 (JP) ..... 2002-322289

(51) Int. Cl.
*G10H 1/46* (2006.01)

(52) U.S. Cl. ..... 84/633; 84/658

(58) Field of Classification Search ..... 84/633, 84/658

See application file for complete search history.

(56) References Cited

U.S. PATENT DOCUMENTS 5,363,147 A * 11/1994 Joseph et al. ..... 348/738
6,304,846 B1 10/2001 George et al.
6,906,695 B1 * 6/2005 Ishida et al. ..... 345/156
2001/0014161 A1 * 8/2001 Baiker et al. ..... 381/59
2003/0004701 A1 * 1/2003 Ueta et al. ..... 704/1

FOREIGN PATENT DOCUMENTS

JP 04052692 * 2/1992
JP 09127951 A 5/1997
JP 09160547 A 6/1997

* cited by examiner

*Primary Examiner*—Marlon T. Fletcher
*Assistant Examiner*—David S. Warren
(74) *Attorney, Agent, or Firm*—VolentineFrancos&Whitt,PLLC

(57) ABSTRACT

A music playback unit corrects the frequency characteristics of a speaker installed in a portable telephone, without using an equalizer. The musical score data is stored in a first memory, and data for correcting the velocity of musical score data for each velocity of each note is stored in a second memory. The sound generator driver reads the musical score data from the first memory, and reads the correction data from the second memory, and also corrects the velocity of the musical score data by substituting the musical score data and correction data in a predetermined calculation formula. The musical score data after the velocity is corrected is played by the MIDI sound generator, amplifier and speaker.

20 Claims, 7 Drawing Sheets

FIG. 4

```
 ADDRESS : +0 +1 +2 +3 +4 +5 +6 +7 +8 +9 +A +B +C +D +E +F 0123456789ABCDEF
00000000 : 4D 54 68 64 00 00 00 06 00 00 00 01 00 60 4D 54 Mthd........`MT
00000010 : 72 6B 00 00 00 BF 00 FF 02 23 4B 41 57 41 49 20 rk...ソ.・.#KAWAI
00000020 : 4D 55 53 49 43 41 4C 20 49 4E 53 54 2E 20 4D 46 MUSICAL INST. MF
00000030 : 47 2E 20 43 4F 2E 2C 20 4C 54 44 2E 00 00 FF 03 G. CO., LTD...・.
00000040 : 07 82 A4 82 B3 82 AC 00 00 FF 58 04 02 02 18 08 ..、.ウ.ャ..・X.....
00000050 : 00 FF 51 03 0C B7 35 00 FF 54 05 00 00 00 00 00 .・Q..ｷ5.・T......
00000060 : 00 FF 59 02 00 00 00 C0 00 00 90 41 58 56 90 41 .・Y....ﾀ・..AXV.A
00000070 : 00 0A 90 41 58 2B 90 41 00 05 90 45 58 2B 90 45 ...AX+.A...EX+.E
00000080 : 00 05 90 47 58 2B 90 47 00 05 90 45 58 2B 90 45 ...GX+.G...EX+.E
00000090 : 00 05 90 47 58 30 90 47 00 30 90 41 58 2B 90 41 ...GX0.G.0.AX+.A
000000A0 : 00 05 90 41 58 2B 90 41 00 05 90 41 58 2B 90 41 ...AX+.A...AX+.A
000000B0 : 00 05 90 45 58 2B 90 45 00 05 90 47 58 2B 90 47 ...EX+.E...GX+.G
000000C0 : 00 05 90 45 58 2B 90 45 00 05 90 47 58 30 90 47 ...EX+.E...GX0.G
000000D0 : 00 00 FF 2F 00                                 ..・/.
```

NOTE ON

NOTE OFF

FIG. 8

INSTRUMENT: GRAND PIANO

| | | VELOCITY | | |
|---|---|---|---|---|
| | | 0 ---------- | V | ---------- 127 |
| NOTE | 0 | | | |
| | ⋮ | | | |
| | n | | S(n,V) | |
| | ⋮ | | | |
| | 127 | | | |

MUSIC PLAYBACK UNIT AND METHOD FOR CORRECTING MUSICAL SCORE DATA

BACKGROUND OF THE INVENTION

1. Field of the Invention

The present invention relates to a technology for playing such musical score data as MIDI (Music Instrument Digital Interface) data, and more particularly to a technology for improving the sound quality of played sound.

2. Description of Related Art

The spread of portable communication terminals, such as portable telephone and PHS (Personal Handyphone System) is being promoted recently. Many portable communication terminals today have a music playback function. Typical use of this music playback function is notifying by sound when a telephone call or email is received. Many portable communication terminals today can notify the arrival of a telephone call and the reception of an email to the user, not by an ordinary call up sound, but by a melody sound. Additionally portable communication terminals which can play melody for listening to music are already known.

For portable communication terminals, MIDI, for example, is used as a standard for music playback. MIDI is a technology not for converting sound itself into data, but for converting musical instrument performance information into data. For example, when the instrument is a keyboard, such musical performance operation as "pressing keys on the keyboard with fingers", "releasing fingers from the keyboard", "stepping on a pedal", "removing feet from a pedal" and "changing tone" is converted into data. The musical score data conforming to the MIDI standard is called "MIDI data". As technology for playing MIDI data, technology stated in Japanese Laid-Open Patent Application Nos. 9(1997)-127951 and 9(1997)-160547, for example, are known.

Musical score data, such as MIDI data, is stored in a portable communication terminal during manufacturing, or is downloaded to a portable communication terminal using communication functions. The service to download musical score data to a portable communication terminal can dramatically increase the choices of a played music, so it is used by many users.

As portable communication terminals having music playback functions spread, the demand for improving the sound quality of played sounds has the tendency to increase. Today a sound quality which satisfies listening to a melody, and not just satisfying the level of notifying by sound, is demanded.

To improve the sound quality, it is desirable to use a high performance speaker. However it is difficult to install a high performance speaker in a portable communication terminal. This is because a portable communication terminal demands not only an improvement in the sound quality but also a decrease in the size and weight of the terminal. Therefore a very small speaker, with less than a 1 centimeter diameter, for example, is installed in a normal portable communication terminal. Small speakers generally have characteristics where the gain (decibel) of a high tone is large and the gain of a low tone is small. Normally, it is difficult to obtain sufficient gain at a 500 Hz or less frequency for a speaker with less than a 1 centimeter diameter.

Also the type of speaker to be installed in a portable communication terminal differs depending on the manufacturer and model of the terminal. Therefore the characteristics of speakers are not same, but differ depending on the manufacturer and model of the terminal.

A method for improving the sound quality of a small speaker is shifting the entire played sound to the high tone side. By this method, the gain of the played sound can be increased, and consequently the user can hear the played sound more easily. This method, however, can improve the usability of a notifying sound, but cannot assure sufficient sound quality in terms of listening to a melody.

Another method for improving the sound quality is using an equalizer. An equalizer is a device for adjusting the frequency characteristics of an acoustic signal. By increasing the amplification factor of an acoustic signal with respect to the low frequency component, the low tone gain of a speaker can be substantially increased. Additionally the dispersion of the sound quality due to the differences of the characteristics of a speaker can be suppressed by changing the equalizer settings according to the type of speaker.

However, it is difficult to install an equalizer in a portable communication terminal, since the terminal size increases and price increases. An equalizer can be configured by software, but it is difficult to use this software in a portable communication terminal. Because a high performance processor must be installed in the portable communication terminal, which increases the size of the device and increases price.

Such problems are not limited to portable communication terminals, but are common to music playback units where a high performance speaker and circuit cannot be installed.

SUMMARY OF THE INVENTION

It is an object of the present invention to provide a technology for improving the sound quality of the music playback device without using a high performance speaker and equalizer.

(1) An music playback unit according to the first invention comprises a first memory for storing musical score data, a second memory for storing correction data for correcting the musical score data for each velocity of each note, a correction section for correcting the velocity of musical score data read from the first memory using the correction data read from the second memory, and a playback section for loading the musical score data after correction from the correction section and playing sound according to this musical score data.

According to the first invention, velocity of the musical score data can be corrected using the correction data stored in the second memory in the music playback unit. Therefore by storing the correction data according to the characteristics of the speaker installed in this music playback device in the second memory, the sound quality of the playback sound can be improved without using a high performance speaker and equalizer.

(2) A correction method for musical score data according to the second invention comprises a step of measuring the acoustic power of each velocity for each note, a step of standardizing the respective measurement result by the measurement result on a specified velocity of a specified note, and a step of correcting the velocity of the musical score data using the standardized measurement result.

According to the second invention, the velocity of the musical score data can be corrected using the correction data created according to the measurement result of the acoustic power. Therefore by measuring the acoustic power using a speaker actually installed in the music playback unit or a speaker having the same characteristics as this speaker, correction which highly matches with the characteristics of the speaker can be performed.

BRIEF DESCRIPTION OF THE DRAWINGS

Other objects and advantages of the present invention will be described with reference to the accompanying drawings.

FIG. 4 is a data configuration diagram for describing the musical score data correction method according to the present embodiment;

FIG. 8 is a conceptual diagram depicting the configuration of the data base which is stored in the DB memory in FIG. 1;

DESCRIPTION OF THE PREFERRED EMBODIMENTS

Figure 1:
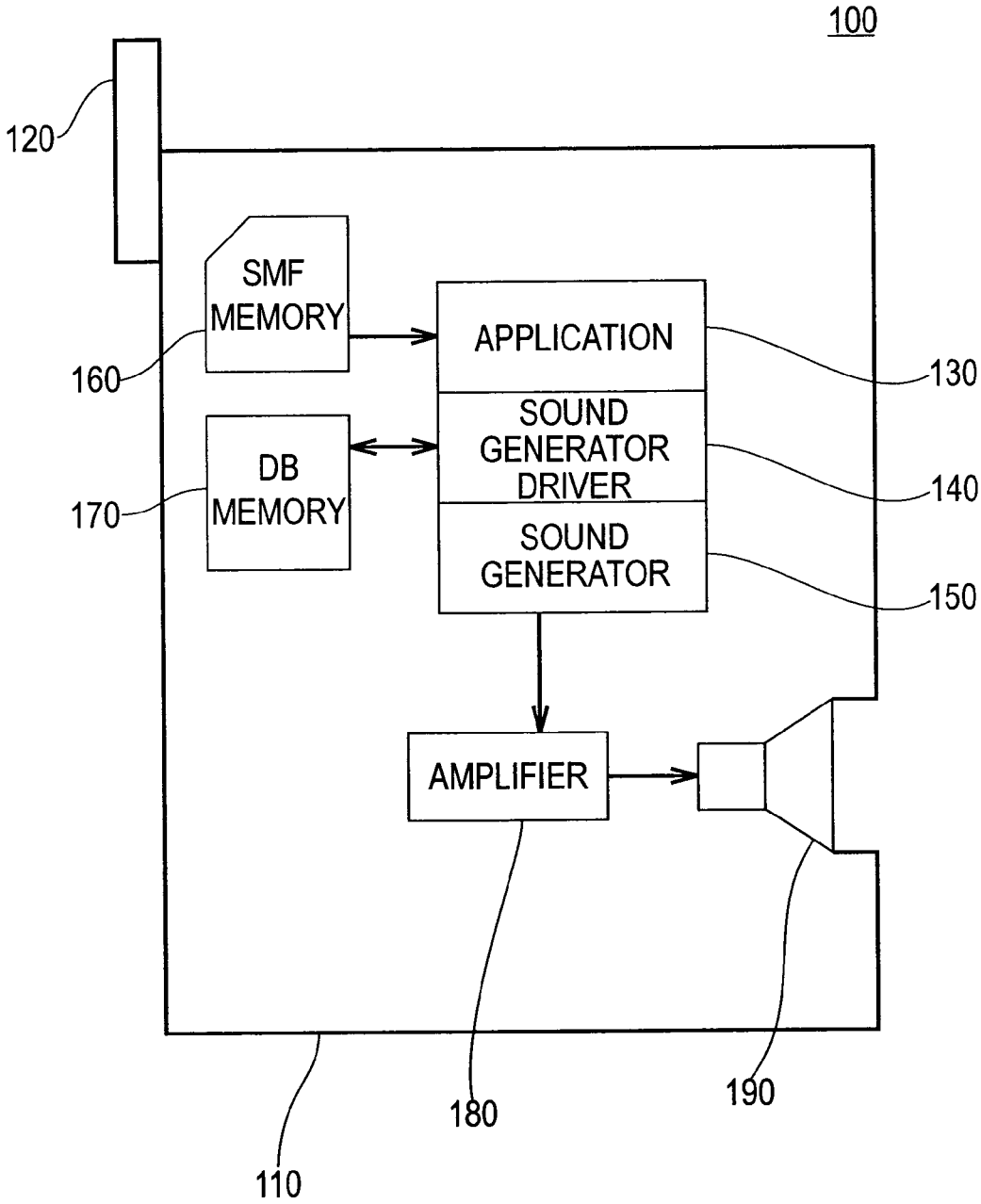
FIG. 1 is a block diagram depicting a general configuration of the portable telephone according to the present embodiment.

Embodiments of the present invention will now be described with reference to the drawings, using the case of applying the present invention to a portable telephone as an example. The size, shape and positional relationship of each composing element in the drawings are shown to be general enough to understand the present invention, and numerical conditions to be described below are only examples.

FIG. 1 is a block diagram depicting the general configuration of the portable telephone 100 according to the present embodiment.

As FIG. 1 shows, this portable telephone 100 is comprised of the body 110, antenna 120, application 130, sound generator driver 140, sound generator 150, SMF (Standard MIDI File) memory 160, DB (Data Base) memory 170, amplifier 180 and speaker 190.

The body 110 has components other than 120–190.

The antenna 120 is used for the portable telephone 100 to communicate. Using this antenna 120 and communication circuit (not illustrated), SMF (mentioned later) can be downloaded from the server of a communication company or a content provider.

The application 130 reads the MIDI data from the SMF memory 160 and supplies it to the sound generator driver 140. The application 130 controls the sound generator driver 140 to correct MIDI data and drive the sound generator 150. The application 130 is called the "MIDI player", for example. This application 130 is for example constructed as software in the LSI (Large Scale Integration), which is not illustrated.

The sound generator driver 140 receives the MIDI message from the application 130 and reads the correction data from the DB memory 170. And using this correction data, the sound generator driver 140 corrects the musical score data written in the MIDI message. Also the sound generator driver 140 drives the sound generator 150 based on the corrected music score data. The sound generator driver 140 is for example constructed as software in the CPU, which is not illustrated.

The sound generator 150 generates and outputs an analog acoustic signal according to control of the sound generator driver 140.

The SMF memory 160 is a memory for storing SMF. The SMF (Standard MIDI File) is a standard file format for recording musical score data by a MIDI message. As mentioned above, the SMF is downloaded using the antenna 120 and the communication circuit (not illustrated). It is also possible to store SMF in the SMF memory 160 in advance when the portable telephone 100 is manufactured.

The DB memory 170 is a memory for storing the correction data base. In this data base, data for correcting the musical score data in the MIDI data is stored. The correction data will be described in detail later.

The amplifier 180 amplifies the acoustic signal which is input from the sound generator 150.

The speaker 190 plays the acoustic signal which is input from the amplifier 180.

Figure 2:
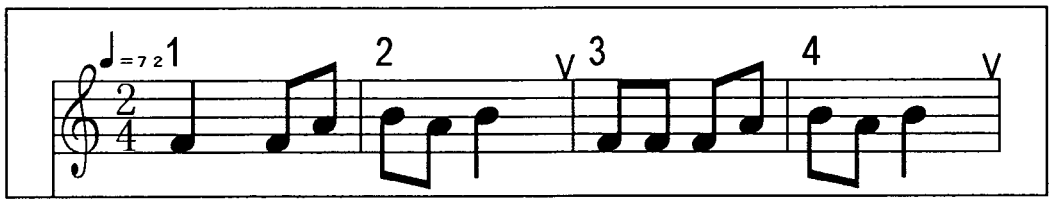
FIG. 2 is a musical score to be used for describing the musical score data correction method according to the present embodiment.
Figure 3:
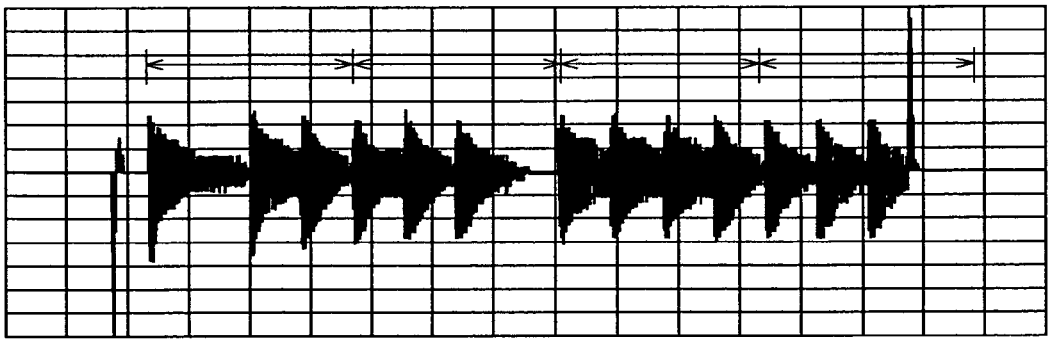
FIG. 3 is an acoustic waveform diagram for describing the musical score data correction method according to the present embodiment.

Now the principle of musical score data correction in the present embodiment will be described. FIG. 2 shows a part of the score of the old Japanese children's song "Usagi". FIG. 3 shows the waveform when this score is played using MIDI technology. The waveform in FIG. 3 is not the waveform obtained by actual measurement, but is the waveform played by software. The waveform in FIG. 3 can be obtained using application software for converting an SMF file into a WAV file and application software for displaying the data of a WAV file in waveform. As a comparison between FIG. 2 and FIG. 3 shows, note (that is, musical scale) and waveform correspond to each other one-to-one. The waves in FIG. 3 all look the same, but the frequency of each wave differs depending on the note. For example, the basic frequency of F, which is the first and second notes, is 87.3 Hz, the basic frequency of A, which is the third note, is 110 Hz. In MIDI, notes are expressed as numbers. 1–127 are defined as the note numbers in MIDI. The note number of F is 41. The note number of A is 45. In a portable telephone which has a chord function, accompaniment is added to the musical score in FIG. 2. For accompaniment, the waveform in FIG. 3 and the waveform of the accompaniment are composed, so sound with very complicated waveforms is generated. As mentioned later, the acoustic power is corrected for an individual short sound before composition, not for the sound after composition.

FIG. 4 shows a part of MIDI data corresponding to the musical score "Usagi" in binary format. As mentioned above, in MIDI a musical score operation such as "pressing the keyboard with fingers" and "releasing fingers from the keyboard" is converted into data. Each musical performance operation is expressed by data called the "MIDI message". MIDI message includes such information as "Note ON" and "Note OFF". "Note ON" means sounding, and corresponds to the operation of pressing the keyboard with a finger. "Note OFF" means silencing, and corresponds to the operation of releasing a finger from the keyboard.

Now out of F, F and A of the first measure of "Usagi", the first F will be described as an example. In the example of FIG. 4, Note ON of the first F is executed by data "00 90 41 58", and Note OFF of this F is executed by data "56 90 41 00".

Out of the data "00 90 41 58", the first numeric value "00" indicates the value of delta time. Delta time means relative time from the previous MIDI message. When delta time is "00", the sound indicated by this data is generated simultaneously with the previous sound. The second numeric value "90" indicates that this command is Note ON, and uses MIDI channel "0". MIDI provides MIDI channels, since the musical performance information of a plurality of parts is transferred by one series of signals. The number of MIDI channels is 16 at the maximum, that is 0–15. The third numeric value "41" indicates that this note is F. The last numeric value "58" indicates a value of velocity. The velocity means the speed of pressing the keyboard with fingers, and is a parameter to indicate the intensity of sound. As described later, the present invention attempts to improve the sound quality by correcting this velocity according to speaker characteristics. 0–127 are defined as a value of velocity.

In the data "56 90 41 00", the first numeric value "56" is delta time. Delta time "56" indicates that the length of the tone is a quarter note. The second numeric value "90" indicates that this command is Note ON, and uses MIDI channel "0". The third numeric value "41" indicates that this note is F. And the fourth numeric value "00"is a value of velocity. Since velocity is "00", this data substantially becomes a command of "Note OFF".

Figure 5:
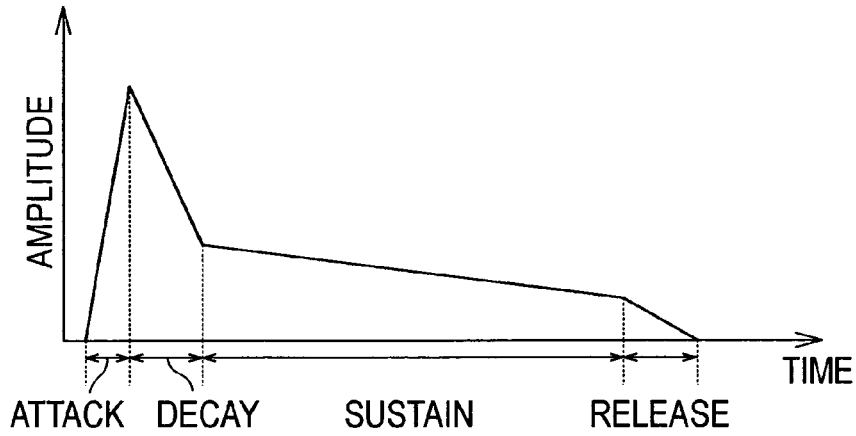
FIG. 5 is a diagram depicting the envelope of an acoustic waveform for describing the musical score data correction method according to the present embodiment.

FIG. 5 is a graph depicting the waveform of one note as an envelope. In FIG. 5, the ordinate is amplitude, and the abscissa is time. The envelope in FIG. 5 corresponds to one of the continuous waveforms shown in FIG. 3. This envelope is called the "ADSR curve". As FIG. 5 shows, the ADSR curve is comprised of a sharp rise section called the "attack", a fall section called the "decay", a mild and relatively long fall section called the "sustain", and a last attenuation called the "release".

Figure 6:
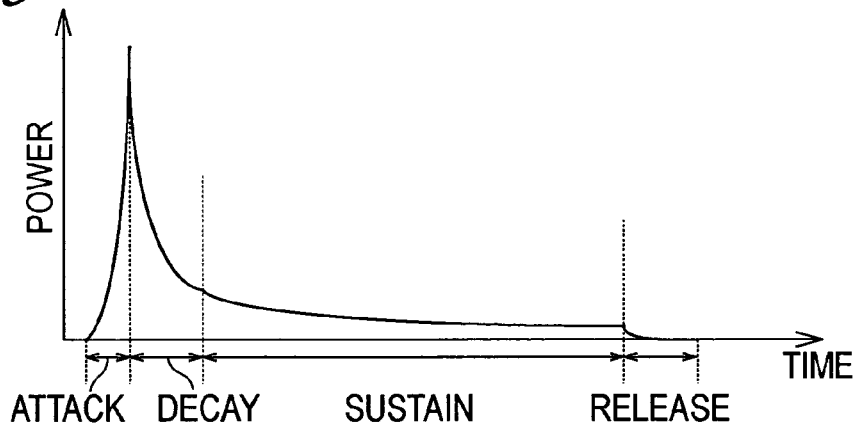
FIG. 6 is a diagram depicting the envelope of an acoustic power for describing the musical score data correction method according to the present embodiment.

FIG. 6 is a graph depicting the envelope of the acoustic power waveform. In FIG. 6, the ordinate is the acoustic power, and the abscissa is time. The envelope in FIG. 6 can be obtained by calculating the square average of one waveform (see FIG. 3) and removing the high frequency component from the result of this calculation. Since the square of the amplitude of the musical performance waveform is in proportion to the acoustic power, the envelope of the power waveform can be obtained by such a method.

Figure 7:
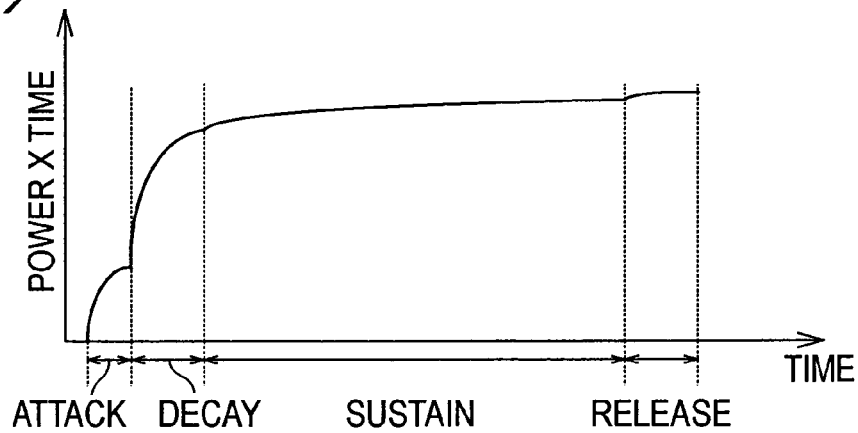
FIG. 7 is a graph depicting an acoustic power integration value for describing the musical score data correction method according to the present invention.

FIG. 7 is a graph depicting the integration result of the power waveform in FIG. 6. In FIG. 7, the ordinate is a product of power and time, and the abscissa is time. As FIG. 7 shows, the acoustic power increases primarily in the attack section and decay section, and only slightly increases in the sustain section and release section. The acoustic power in the sustain section depends on the duration time of the note, that is, the delta time. Normally, the acoustic power becomes zero when the note is silenced by the note OFF command.

If the velocity is 20 or more, the amplitude roughly depends on the square of the velocity. If the velocity is 20 or less, the amplitude depends on the characteristics of the sound generator 150, so amplitude depends little on the velocity. However, if velocity is 20 or less, the acoustic power is extremely small, therefore the influence of error is small even if it is regarded that amplitude depends on the velocity. As a consequence, even if it is assumed that amplitude is in proportion to the square of the velocity at all the values of velocity, the influence of error can be ignored. In addition, as described with reference to FIG. 6, the acoustic power is in proportion to the square of the amplitude. Therefore the sound power can be regarded to be in proportion to the fourth power of the velocity at all the values of velocity.

In other words, when it is assumed that the frequency characteristics of the speaker 190 are ideal, the relationship between the expected value Pi of the acoustic power and the MIDI velocity V is given by the following formula (1). Here c is a constant. The following formula (1) is a formula on instantaneous power, but if the voltage V is constant, a relationship the same as formula (1) is established for the integration value of the acoustic power.

$$Pi=C\times V^4 \tag{1}$$

In this embodiment, the measured values of acoustic power are used for creating the correction data. The method for measuring the acoustic power will be described later. The acoustic power is measured for all the velocities of all the notes. And these measured values are standardized using a specified velocity of a specified note. For example, the measured value when the note is No. 60 C4 (261.6 Hz) or No. 69A (440 Hz) and velocity is 64, is based as a standard value, and all the other measured values can be standardized. If the measured value is Pmes and the standard value is Pstd, the standardized acoustic power S(n, V) is given by the following formula (2). Here n is a value of the note, and V is a level of velocity. If Pmes=Pstd, the standardized value S(n, V0) becomes 1.0.

$$S(n, V) = \frac{Pmes}{Pstd} \tag{2}$$

Standardization is performed for all the velocities of all the notes. The acoustic power S(n, V) obtained by this standardization is created in a data base and is stored in the DB memory 170 (see FIG. 1).

FIG. 8 is a conceptual diagram depicting the configuration of the data base. It is preferable that a data base is created for each type of instrument. For example, in the case of an Electone™, an error between the above formula (1) and the actual acoustic power may increase. For such an instrument, a data base need not be created. Each data base includes acoustic power S(n, V) for all the velocities of all the notes of this instrument, as shown in FIG. 8.

Here, based on the formula (1) above, the relationship of the following formula (3) is established for the standard values S(n, V) and S(n, V0) of the acoustic power. Here, V0 is a standard value of the velocity. And the following formula (4) is obtained from the formula (3).

$$S(n,V):S(n,V0)=C\cdot V^4:C\cdot V0^4 \tag{3}$$

$$S(n, V) = S(n, V0)\cdot\left(\frac{V}{V0}\right)^4 \tag{4}$$

Therefore if the speaker has ideal frequency characteristics, the standardized acoustic power S(n, V) can be calculated by substituting the velocity V of the MIDI data, which is read from the SMF file (see FIG. 1), to formula (4). However, in reality the frequency characteristics of a speaker are not ideal, and therefore the power of played sound in the low frequency area becomes smaller than S(n, V) given by the above formula (4). Here, if the velocity when a measured value is the same as the acoustic power calculated by the formula (4) is Vrev, then the relationship of the following formula (5) is established between the standard value of the acoustic power S(n, V) and S(n, Vrev). And the following formula (6) is obtained from formula (5).

$$S(n,Vrev):S(n,V)=C\cdot Vrev^4:C\cdot V^4 \tag{5}$$

$$S(n, V) = S(n, Vrev)\cdot\left(\frac{V}{Vrev}\right)^4 \tag{6}$$

The following formula (7) is established from the formulas (4) and (6). And the following formula (8) is obtained by transforming the formula (7).

$$S(n, V0)\left(\frac{V}{V0}\right)^4 = S(n, Vrev)\left(\frac{V}{Vrev}\right)^4 \tag{7}$$

$$Vrev = \frac{V^2}{V0}\cdot\left(\frac{S(n, V0)}{S(n, V)}\right)^{\frac{1}{4}} \tag{8}$$

As mentioned above, S(n, V0)=1.0. Therefore the formula (8) can be transformed to be the formula (9).

$$Vrev = \frac{V^2}{V0}\cdot S(n, V)^{-\frac{1}{4}} \tag{9}$$

When the sound generator driver 140 receives MIDI data in the SMF memory 160 from the application 130, the sound generator driver 140 reads the standardized acoustic power S(n, V) corresponding to the velocity V of this MIDI data from the DB memory 170. And by substituting the velocity V, standard velocity V0 and standardized acoustic power S(n, V) to the formula (9), the corrected velocity Vrev is obtained. The value of velocity is an integer in MIDI standard. Therefore the calculation result of the formula (9) is converted into an integer. The level of velocity is 127 or less in MIDI standard. Therefore the calculation result of the formula (9) is converted into a value which does not exceed 127.

The sound generator driver 140 drives the sound generator 150 based on the velocity Vrev obtained in this way. By this, the speaker 190 plays the sound of the power corresponding to the corrected velocity Vrev. In this embodiment, velocity is corrected using the above formula (9), so even if the frequency characteristics of the speaker 190 are distant from the ideal, the sound of the power corresponding to the velocity V of the SMF data can be played.

The acoustic power of a chord can be regarded as the composition of acoustic power of a single sound. Therefore sound quality can be improved by correcting the acoustic power for each single sound, and then composing these single sounds.

As mentioned above, according to the present embodiment, it is approximated that the acoustic power is in proportion to the fourth power of the velocity at all the values of velocity (see above formula (1)). On the other hand, if the velocity is 20 or less, the acoustic power is not in proportion to the fourth power of velocity. However, if the acoustic power becomes too high at a low tone, resonance or parasitic oscillation may be generated. Therefore even if velocity is 20 or less, a better sound quality will be obtained by performing correction by the above formula (9).

Figure 9:
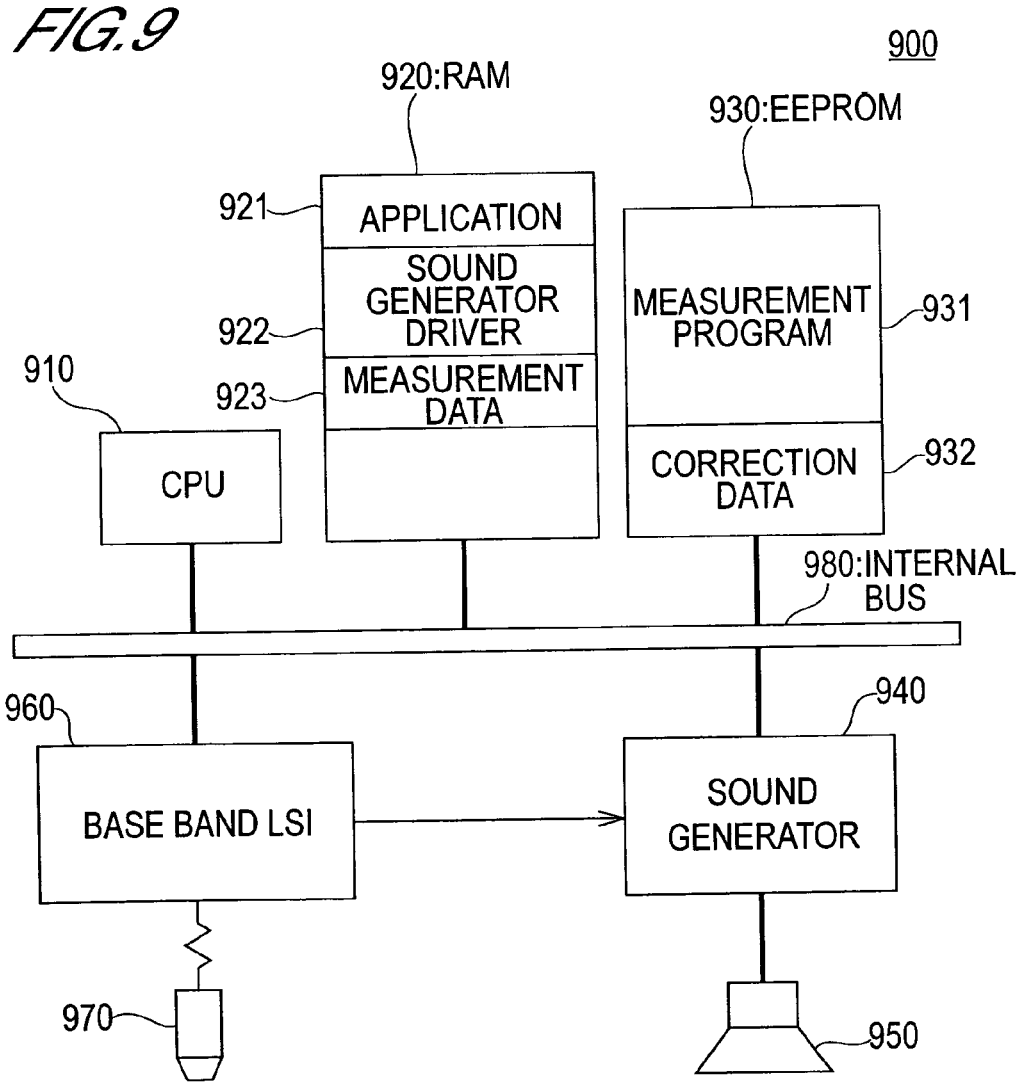
FIG. 9 is a block diagram depicting a conceptual configuration of the acoustic power measurement device according to the present embodiment.

Now the measurement method for acoustic power will be described. FIG. 9 is a block diagram depicting a conceptual configuration of the acoustic power measurement device according to the present embodiment.

As FIG. 9 shows, this acoustic power measurement device 900 is comprised of a CPU (Central Processing Unit) 910, RAM (Random Access Memory) 920, EEPROM (Electrically Erasable Programmable Read Only Memory) 930, sound generator 940, speaker 950, base band LSI (Large Scale Integration) 960, microphone 970 and internal bus 980. In the RAM 920, the application 921, sound generator driver 922 and measurement data 923 are stored. In the EEPROM 930, the measurement program 931 and correction data 932 are stored. The application 921, sound generator driver 922, sound generator 940 and speaker 950 constitute a virtual portable telephone. The sound generator 940 and speaker 950 have acoustic characteristics the same as the portable telephone 100, on which the data base for correction is installed. For the microphone 970, a microphone which has sufficiently good frequency characteristics is used. To increase the acoustic power to be input to the microphone 970, it is effective to use an acoustic reflector (not illustrated).

The CPU 910 executes the measurement program 931. The application 921 and sound generator driver 922 are executed under the control of this measurement program 931. By execution of the application 921 and sound generator driver 922, the same processing as application 130 and sound generator driver 140 of the portable telephone 100 (see FIG. 1) can be performed. Also by the measurement program 931, operation of the base band LSI 960 is controlled.

To start measurement, the measurement program 931 specifies an instrument, a piano for example. When the execution of the measurement program 931 starts, the base band LSI 960 sends the control data to the sound generator 940. The sound generator 940 drives the speaker 950 based on this control data. The speaker 950 sequentially plays the sound of the specified instrument of the base band LSI 960. This playback is executed for all the velocities of all the notes. In other words, a single sound is played for the first note, while changing the velocity in steps, and when this playback ends, similar single sound playback is executed for the next note. Thereafter as well, the playback of each note is executed in the same way while changing the velocity in steps. The played sound is input to the microphone 970. The base band LSI 960 measures the power of the sound which is input to the microphone 970. The measured acoustic power is converted into digital data by the analog/digital converter (not illustrated) in the base band LSI 960. The digitized acoustic power is stored in the RAM 920 as measurement data 923.

When measurement ends, the CPU 910 corrects the measurement data 923. All the sounds which are output from the speaker 950 are not input to the microphone 970, so a predetermined amplification processing is required. In addition, to eliminate the influence of noise, amplitude at noise level or less must be eliminated by a limiter. If the frequency characteristics of the microphone 970 are sufficiently good, correction for eliminating the influence of these frequency characteristics is unnecessary.

Then the CPU 910 standardizes the measurement data 923 (see formula (2)). The standardized measurement data 923 is stored in the EEPROM 930 as the correction data 932. From this correction data 932, a data base for storing in the DB memory 170 of the portable telephone 100 is created (see FIG. 8).

Figure 10:
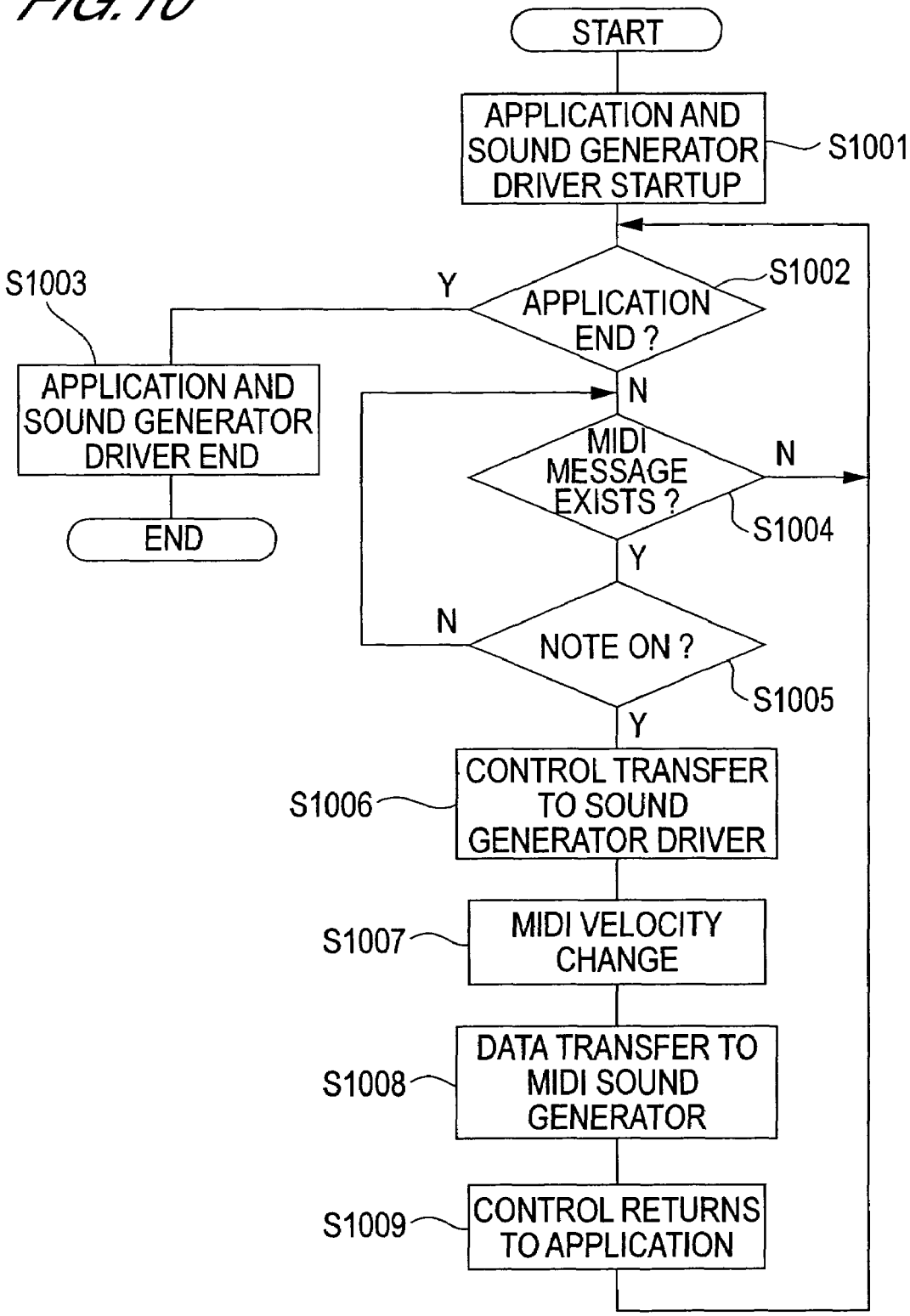
FIG. 10 is a flow chart depicting the general operation of the portable telephone according to the present invention.

Finally the general operation of the portable telephone 100 shown in FIG. 1 will be described using the flow chart in FIG. 10.

At first, the application 130 and sound generator driver 140 are started up by the CPU, which is not illustrated (S1001). At this time, the application 130 is the control target of the CPU. The application 130 judges whether termination has been instructed (S1002). If it is judged that termination has been instructed, termination processing of the application 130 and sound generator driver 140 are executed (S1003).

If it is judged that termination has not been instructed in step S1002, on the other hand, the application 130 checks the MIDI message of the SMF memory 160 (S1004). If the MIDI message of the SMF memory 160 is not detected, processing of the application 130 returns to step S1002. If the MIDI message is detected, the application 130 checks Note ON/Note OFF of the MIDI message (S1005). And if the MIDI message is Note OFF, processing returns to step S1004.

If it is judged that the MIDI message is Note ON in step S1005, the control target of the CPU shifts from the application 130 to the sound generator driver 140 (S1006). And the sound generator driver 140 corrects the velocity V in the MIDI message using the above formula (9) (S1007). By this, the corrected velocity Vrev is calculated. Then the sound generator driver 140 sends this velocity Vrev to the sound generator 150 (S1008). And the control target of the CPU is returned from the sound generator driver 140 to the application 130 (S1009). Then the application 130 executes processing in step S1002 and after.

As described above, according to this embodiment, data for correcting the frequency characteristics of the speaker 190 is measured, a data base is created using this measurement result, and MIDI data is corrected using this data base. Therefore according to this embodiment, sound quality of the portable telephone 100, where a speaker 190 with poor frequency characteristics is installed, can be improved.

Also according to this embodiment, dispersion of the frequency characteristics of the played sound, depending on the manufacturer and the model, can be prevented by creating a data base for each model of a portable telephone.

Also according to this embodiment, the size of the portable telephone does not increase and price thereof does not increase, since an equalizer circuit or equalizer software need not be used.

In addition, according to this embodiment, only the DB memory 170 is added and a correction calculation function (see above formula (9)) is installed in the sound generator driver 140, and application 130 need not be changed. Development is easier to change the sound generator driver 140 than to change the application 130. Therefore this embodiment requires minimal labor during development and low development cost. The effect of this invention can also be obtained as well by creating a correction calculation function in other software, such as application 130, or by using independent software for correction calculation. It is also possible to install hardware for correction calculation.

This embodiment can be used without changing the currently existent MIDI data, so it can be employed easily.

In the present embodiment, MIDI data is corrected in the portable telephone 100. However, pre-corrected data may be downloaded to the SMF memory 160 of the portable telephone. In this case, the correction data base is created in advance for each model of portable telephone. Also MIDI data is created based on the assumption that the frequency characteristics of a speaker are ideal. And this MIDI data is corrected using a correction data base. Then MIDI data after correction is downloaded to the SMF memory of the portable telephone. According to this method, played sound quality can be improved even with a conventional telephone (that is a portable telephone without the correction function of DB memory 170 and sound generator driver 140). Additionally, the content provider can provide a high sound quality MIDI file corresponding to each model of portable telephone to the user at minimal labor and low cost. In the same way, pre-corrected data may be stored in the SMF memory 160 of the portable telephone during manufacture. In this case, the manufacturer of the portable telephone can implement high quality playback sound without creating MIDI data for each model, if a correction data base for each model is created in advance.

In the present embodiment, the standardized acoustic power S(n, V) is stored in the DB memory 170, and the above formula (9) is calculated using this acoustic power S(n, V). However, the above formula (9) may be calculated for all acoustic powers S(n, V) in advance, and the calculation result Vrev may be created in a data base and stored in the DB memory 170. In this case, the sound generator driver 140 merely rewrites each velocity of MIDI data, which is read from the SMF memory 160, to the velocity stored in the DB memory 170.

As described above, according to the present invention, sound quality of the music playback unit can be improved without using a high performance speaker and equalizer.

What is claimed is:

1. A music playback unit comprising:

a first memory for storing musical score data;

a second memory for storing correction data for correcting said musical score data for each velocity of each note;

a correction section for correcting the velocity of said musical score data read from said first memory using said correction data read from said second memory; and a playback section for loading said corrected musical score data after correction by said correction section and playing sound according to said corrected musical score data, wherein after acoustic power of each velocity is measured for each note, each measurement result is respectively standardized using a specified velocity of a specified note, and the standardized acoustic power is stored in said second memory as said correction data, and wherein said correction section corrects each velocity of said musical score data using calculation results determined by the following formula:

$$Vrev = \frac{V^2}{V0} \cdot S(n, V)^{-\frac{1}{4}},$$

wherein S(n,V) is correction data, n is note power, V is velocity, VO is specified velocity, and Vrev is corrected velocity.

2. The music playback unit according to claim 1, wherein said correction section corrects each velocity of said musical score data by converting the calculation results into integers.

3. The music playback unit according to claim 1, wherein said correction section corrects each velocity of said musical score data by converting the calculation results into integers of 127 or less.

4. The music playback unit according to claim 1, further comprising a communication circuit which downloads said acoustic power from a communication network and stores said acoustic power in said first memory.

5. The music playback unit according to claim 1, wherein said musical score data is music instrument digital interface data.

6. A music playback unit comprising:

a first memory for storing musical score data;

a second memory for storing correction data for correcting said musical score data for each velocity of each note;

a correction section for correcting the velocity of said musical score data read from said first memory using said correction data read from said second memory; and a playback section for loading said corrected musical score data after correction by said correction section and playing sound according to said corrected musical score data, wherein after acoustic power of each velocity is measured for each note, each measurement result is respectively standardized using a specified velocity of a specified note to provide standardized acoustic power, and wherein said correction data is determined from calculation results using the following formula, and then stored in said second memory;

$$Vrev = \frac{V^2}{V0} \cdot S(n, V)^{-\frac{1}{4}},$$

wherein S(n,V) is standardized acoustic power, n is note, V is velocity, VO is specified velocity, and Vrev is corrected velocity.

7. The music playback unit according to claim 6, wherein said correction data are values obtained by converting said calculation results into integers.

8. The music playback unit according to claim 6, wherein said correction data are values obtained by converting said calculation results into integers of 127 or less.

9. The music playback unit according to claim 6, wherein each velocity of said musical score data is corrected by said correction section rewriting the velocity of said musical score data read from said first memory into said correction data.

10. The music playback unit according to claim 6, further comprising a communication circuit which downloads said acoustic power from a communication network and stores said acoustic power in said first memory.

11. The music playback unit according to claim 6, wherein said musical score data is music instrument digital interface data.

12. A correction method for musical score data comprising:

measuring the acoustic power of each velocity for each note;

standardizing each measurement result using a specified velocity of a specified note; and correcting the velocity of the musical score data using said standardized measurement result, wherein each velocity of said musical score data is corrected using calculation results determined by the following equation:

$$Vrev = \frac{V^2}{V0} \cdot S(n, V)^{-\frac{1}{4}},$$

wherein S(n,V) is standardized acoustic power, n is note, V is velocity , VO is specified velocity, and Vrev is corrected velocity.

13. The correction method for musical score data according to claim 12, wherein each velocity of said musical score data is corrected by converting the calculation results into integers.

14. The correction method for musical score data according to claim 12, wherein each velocity of said musical score data is corrected by converting the calculation results into integers of 127 or less.

15. The correction method for musical score data according to claim 12, wherein said measuring, said standardizing, and storing of said standardized measurement result is executed in a music playback unit in a manufacturing stage of the music playback unit, and said correcting is executed during musical performance by the music playback unit.

16. The correction method for musical score data according to claim 12, wherein said measuring, said standardizing, said correcting for all types of velocities, and storing of the corrected velocities in a music playback unit are executed in a manufacturing stage of the music playback unit, and the velocity of said musical score data is replaced with said corrected velocity corresponding thereto during a musical performance by the music playback unit.

17. The correction method for musical score data according to claim 12, wherein said correcting is executed for said acoustic power which is downloaded from a communication network to a music playback unit.

18. The correction method for musical score data according to claim 12, wherein said acoustic power, after said measuring, said standardizing and said correcting are executed, is downloaded from a communication network to a music playback unit.

19. The correction method for musical score data according to claim 12, wherein said acoustic power, after said measuring, said standardizing and said correcting are executed, is stored in a music playback unit in a manufacturing stage.

20. The correction method for musical score data according to claim 12, wherein said musical score data is music instrument digital interface data.

* * * * *